US007078854B2

(12) United States Patent
Niibori et al.

(10) Patent No.: US 7,078,854 B2
(45) Date of Patent: Jul. 18, 2006

(54) IMAGE DISPLAY APPARATUS HAVING SPACER WITH FIXTURES

(75) Inventors: Kenji Niibori, Kanagawa (JP); Yasushi Shioya, Kanagawa (JP); Nobuyuki Takahashi, Kanagawa (JP); Kazuyuki Ueda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 262 days.

(21) Appl. No.: 10/627,716

(22) Filed: Jul. 28, 2003

(65) Prior Publication Data

US 2004/0075378 A1 Apr. 22, 2004

(30) Foreign Application Priority Data

Jul. 30, 2002 (JP) ..... 2002-221183

(51) Int. Cl.

| | |
|---|---|
| ***H01J 1/62*** | (2006.01) |
| ***H01J 1/88*** | (2006.01) |
| ***H01J 19/42*** | (2006.01) |
| ***H01J 63/04*** | (2006.01) |

(52) U.S. Cl. ..... 313/495; 313/243; 313/292; 313/238

(58) Field of Classification Search ..... 313/292, 313/495, 243, 238

See application file for complete search history.

(56) References Cited

U.S. PATENT DOCUMENTS

| | | | | |
|---|---|---|---|---|
| 5,859,497 | A | 1/1999 | Anderson et al. | 313/495 |
| 5,952,775 | A | 9/1999 | Sato et al. | 313/422 |
| 6,184,619 | B1 * | 2/2001 | Yamazaki et al. | 313/495 |
| 6,803,715 | B1 * | 10/2004 | Mitsutake et al. | 313/495 |
| 2002/0030435 | A1 | 3/2002 | Sato et al. | 313/495 |
| 2002/0121857 | A1 * | 9/2002 | Yonezawa et al. | 313/495 |

FOREIGN PATENT DOCUMENTS

| | | |
|---|---|---|
| JP | 9-179508 | 7/1997 |
| JP | 2000-251796 | 9/2000 |

* cited by examiner

*Primary Examiner*—Joseph Williams
*Assistant Examiner*—Bumsuk Won
(74) *Attorney, Agent, or Firm*—Fitzpatrick, Cella, Harper & Scinto

(57) ABSTRACT

An image display apparatus includes a first substrate, a second substrate and a spacer provided therebetween and providing an atmospheric pressure resistant structure of a vacuum container formed between the first and second substrates. First and second support members are provided outside an image display area, with the first and second support members being joined together. An electrode is formed on either one of the first and second substrates, bearing the second support member, and is electrically joined to the second support member by a spring contact portion.

1 Claim, 14 Drawing Sheets

IMAGE DISPLAY APPARATUS HAVING SPACER WITH FIXTURES

BACKGROUND OF THE INVENTION

1. Field of the Invention

The present invention relates to an image display apparatus having a spacer.

2. Related Background Art

Among the prior image display apparatus, there are known ones including a support member, called a spacer, in an air-tight container including an image display member, such as a liquid crystal display apparatus, a plasma display apparatus, an electroluminescence apparatus, and an electron beam display apparatus.

In the following, there will be explained an electron beam display apparatus as an example of the image display apparatus having the aforementioned spacer.

FIG. 20 is a perspective view showing an example of a display panel of a plate image display apparatus utilizing an electron emitting element of cold cathode type, in which a part of the panel is cut off in order to show the internal structure. A rear plate 3115, a lateral wall 3116 and a face plate 3117 constitute an outer envelope (air-tight container) for maintaining the interior of the display panel in a vacuum state.

On the rear plate 3115, there is fixed a substrate 3111, on which N×M cold cathode elements 3112 are formed in a matrix shape (N, M being integers equal to or larger than 2 and suitably selected according to a desired number of display pixels). The N×M cold cathode elements 3112 are also wired by row wirings 3113 of a number M and column wirings 3114 of a number N. A part constituted by these substrate 3111, electron emission elements 3112 of cold cathode type, row wirings 3113 and column wirings 3114 is called a multi electron beam source. Also, in at least crossing portions between the row wirings 3113 and the column wirings 3114, an insulating layer (not shown) is provided between both wirings to achieve electrical insulation.

On a lower surface of the face plate 3117, there is formed a fluorescent film 3118 of a phosphor, which is divided into phosphors (not shown) of three primary colors of red (R), green (G) and blue (B). A black colored member (not shown) is provided between the phosphors of respective colors constituting the phosphor film 3118, and a metal back layer 3119 composed for example of Al is provided on a surface of the phosphor film 3118 at the side of the rear plate 3115.

Electrical connecting terminals Dx1–DxM and Dy1–DyN are provided for electrically connecting the display panel and an unrepresented electrical circuit. The terminals Dx1–DxM are electrically connected with the row wirings 3113 of the multi electron beam source, while the terminals Dy1–DyN are electrically connected with the column wirings 3114 of the multi electron beam source, and a terminal Hv is connected with the metal back 3119.

The interior of the air-tight container is maintained at a vacuum of about $1.3\times10^{-3}$ Pa, and, with an increase in the display area of the image display apparatus, there is required means for preventing a deformation or a destruction of the rear plate 3115 and the face plate 3117 by a pressure difference between the interior of the air-tight container and the exterior thereof. In FIG. 20, there is provided a spacer 3120 constituted of a relatively thin glass plate, for withstanding the atmospheric pressure. In this manner the substrate bearing the multi beam electron source and the face plate 3116 bearing the phosphor film 3118 are maintained at a gap less than a millimeter to several millimeters whereby the interior of the air-right container is thus maintained at a high vacuum.

In an image display apparatus employing the display panel explained above, when a voltage is applied to the cold cathode element 3112 through the external terminals Dx1–DxM and Dy1–DyN, electrons are emitted from each cold cathode element 3112. At the same time, a high voltage of several hundred volts to several killovolts is applied to the metal back 3119 through the external terminal Hv to accelerate the emitted electrons thereby causing a collision with an internal surface of the face plate 3117. Thus the phosphor of each color constituting the phosphor film 3118 is excited to emit light, whereby an image is displayed.

The spacer 3120 is positioned efficiently in a number required structurally. In case the spacer 3120 is made shorter than the image area and is positioned within the image area, it is fixed by a connecting member within the image area of the rear plate 3115 and/or the face plate 3117.

Also as disclosed in Japanese Patent Application Laid-open Nos. 9-179508 and 2000-251796, a spacer 3120 longer than the image area can attain a structure resistant to the atmospheric pressure by fixing both ends only. In such case, there may be assumed a method of fixing support members in advance to both ends of the spacer 3120 and fixing such support members with the rear plate 3115 or the face plate 3117 by means of adhesion members.

In image display apparatus including a spacer, since the spacer is provided in plural units according to the display area of the display panel or a thickness of the substrate for the rear plate and the face plate, the number of the spacers increases as the display area becomes larger or as the substrate becomes thinner. As a result, there increases a number of steps for positioning the spacers and there may result an increase in the manufacturing cost.

Also an operation of fixing the plural spacers or the plural support members to the face plate or the rear plate with the connecting members requires a longer time with an increase in the number of spacers, and there may also result an increase in the manufacturing cost.

Also in order to obtain a uniform image quality in the image display apparatus, there is required a high precision in the order of a micron in the fixing position of the spacer. However, a heating step for hardening a connecting member such as an adhesive to be used in fixing the spacer may cause a distortion by a thermal expansion in a jig for spacer fixation, thereby deteriorating the positional precision of the spacer fixation.

Also in forming an air-tight container by heat sealing the rear plate bearing the spacer and the face plate, or in driving the image display apparatus, there may result a dimensional difference by thermal expansion between the spacer and the face plate or rear plate bearing such spacer, thereby causing a destruction of the spacer.

SUMMARY OF THE INVENTION

An objective of the present invention is to provide an image display apparatus having a spacer which is strong and has a sufficient supporting function.

Another objective of the present invention is to provide an image display apparatus having a spacer having an excellent precision of fixing position and of having an extremely lowered influence on a displayed image.

Further another objective of the present invention is to provide an image display apparatus having a spacer with a securely defined potential.

And, it is also an objective of the present invention to provide an image display apparatus with an extremely low danger of tumbling or destruction of a spacer by heat, at the manufacture or during the display.

The present invention's image display apparatus basically comprises: a first substrate provided with a plurality of electron emitting elements in a vacuum container; a second substrate positioned opposite to said first substrate in said vacuum container, said second substrate being irradiated with electrons emitted from said electron emitting elements; at least one spacer disposed on either one of said first and second substrates to provide an atmospheric pressure resistant structure of said vacuum container, said spacer being interposed between said first and second substrates and having a longitudinal direction substantially perpendicular to an opposing direction of said first and second substrates; and a lateral wall positioned inside an external periphery of at least either one of said first and second substrates to provide a sealed structure of said vacuum container. And, the constitution of the present invention image display apparatus is unique in that a first support member for supporting said spacer is provided outside an image display area which is formed between an area of said electron emitting elements of said first substrate and an electron-irradiated area of said second substrate, while a second support member is provided outside said image display area on either one of said first and second substrates, and that said first support member and said second support member are joined together.

In one embodiment, the present invention's image display apparatus includes an air-tight container, and an image display member and a spacer provided in the air-tight container, wherein the spacer is fixed by a weld joining in the air-tight container.

In another embodiment, the present invention's image display apparatus includes an air-tight container, and an image display member and a spacer provided in the air-tight container, wherein the spacer is fixed via a metal member in the air-tight container.

DETAILED DESCRIPTION OF THE PREFERRED EMBODIMENTS

Figure 1:
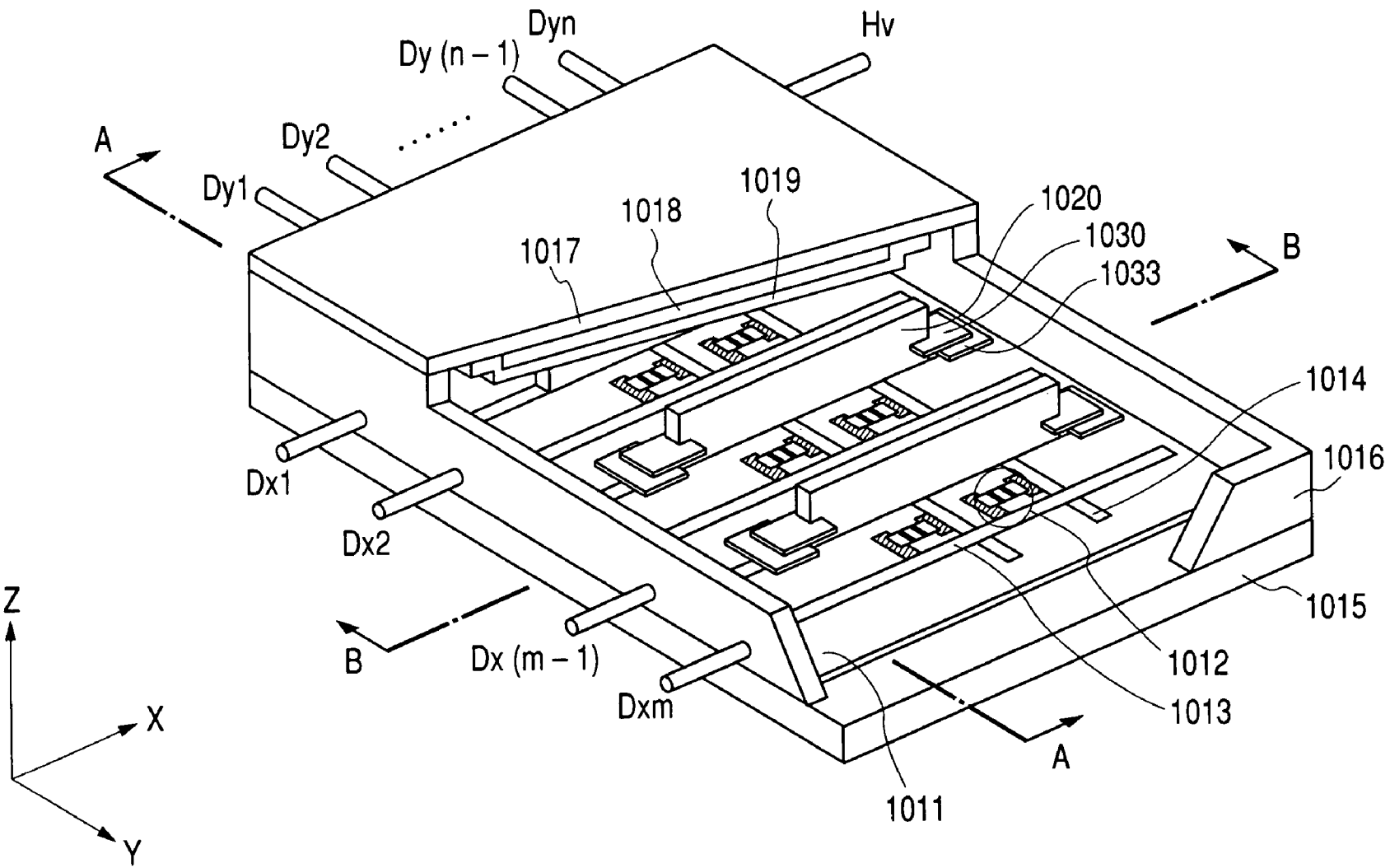
FIG. 1 is a partially cut-off perspective view showing a display panel in which the present invention is applicable.

The present invention, to be explained in the following, is advantageously applicable to an image display apparatus having a support member, called a spacer, in an air-tight container including an image display member, such as a liquid crystal display apparatus, a plasma display apparatus, an EL display apparatus or an electron beam display apparatus.

The present invention provides an image display apparatus including an air-tight container, and an image display member and a spacer in such air-tight container, wherein the spacer is fixed by a weld joining in the air-tight container.

In the image display apparatus of the present invention, it is preferred that the spacer has a potential defining electrode for defining a surface potential of the spacer, and the potential of the potential defining electrode is defined by the aforementioned weld joining to an electrode provided in the air-tight container.

In the image display apparatus of the present invention, it is preferred that the spacer is a plate-shaped spacer and that both ends in a longitudinal direction of the plate-shaped spacer are fixed by the weld joining outside an image display area of the air-tight container.

Also in the image display apparatus of the present invention, it is preferred that the spacer has a conductive member for defining a surface potential of the spacer, and the potential of the conductive member is defined by the aforementioned weld joining to an electrode provided in the air-tight container.

Also in the image display apparatus of the present invention, it is preferred that the weld joining is made between a conductive first support member provided on the spacer and the aforementioned electrode.

Also the present invention provides an image display apparatus including an air-tight container, and an image display member and a spacer in such air-tight container, wherein the spacer is fixed via a metal member in the air-tight container.

Also the present invention provides an image display apparatus including an air-tight container, and an image display member and a spacer in such air-tight container, wherein the spacer is fixed via metal member in the air-tight container.

Also the present invention provides an image display apparatus including, in a vacuum container, a first substrate having plural electron emitting elements; a second substrate opposed to the first substrate in the vacuum container and receiving electrons emitted from the electron emitting elements; at least a spacer provided on either of the first substrate and the second substrate for constituting a structure resistant to the atmospheric pressure, positioned between the first substrate and the second substrate, and having a longitudinal direction substantially perpendicular to an opposing direction of the first substrate and the second substrate; and a lateral wall positioned inside an external periphery of at least either one of the first substrate and the second substrate;

wherein a first support member for supporting the spacer is provided outside an image display area which is formed between an area of the electron emitting elements of the first substrate and an electron-irradiated area of the second substrate, while a second support member is provided outside the image display area on either one of the first substrate and the second substrate, and the first support member and the second support member are joined.

In the aforementioned image display apparatus of the present invention, a more specific preferred configuration is:

an image display apparatus featured in including, in a vacuum container, a first substrate having plural electron emitting elements; a second substrate opposed to the first substrate in the vacuum container and receiving electrons emitted from the electron emitting elements; at least a spacer provided on either of the first substrate and the second substrate for constituting a structure resistant to the atmospheric pressure, positioned between the first substrate and the second substrate, and having a longitudinal direction substantially perpendicular to an opposing direction of the first substrate and the second substrate; and a lateral wall positioned inside an external periphery of at least either one of the first substrate and the second substrate;

wherein a first support member for supporting the spacer is provided outside an image display area which is formed between an area of the electron emitting elements of the first substrate and an electron-irradiated area of the second substrate, while a second support member is provided outside the image display area on either one of the first substrate and the second substrate, and the first support member and the second support member are joined, the apparatus further including following configurations.

It is conceived that the first support member and the second support member are formed by conductive members.

It is also conceived that the first support member and the second support member are weld joined. In such case, the first support member and the second support member may be weld joined by a first joining member.

It is also conceived the first joining member is selected from a group of a solder, a conductive adhesive and a low-melting metal material.

It is also conceived that only an external end of the spacer, in the longitudinal direction of the spacer, is weld joined to the second support member.

It is also conceived that a gap is formed, in a direction substantially perpendicular to a surface on which the spacer is provided of a substrate having the spacer, between a spacer joining portion of the first support member where the first support member is joined to the spacer and the second support member, and that an external end of the first support member in the longitudinal direction of the spacer impinges on the second support member.

It is also conceived that the first support member supports both ends of the spacer in the longitudinal direction thereof.

It is also conceived that the electrode formed on a surface of the spacer and the first support member are electrically joined. In such case, the electrode formed on the surface of the spacer and the first support member may be electrically joined through a conductive joining material. Otherwise, the electrode formed on the surface of the spacer and the first support member may be electrically joined by a contact of a contact portion having spring characteristics and provided on the first support member.

It is also conceived that the electrode formed on either one of the first substrate and the second substrate, having the second support member, is electrically joined with the second support member. In such case, the electrode formed on either one of the first substrate and the second substrate, having the second support member, and the second support member may be electrically joined through a conductive joining material. Otherwise, the electrode formed on either one of the first substrate and the second substrate, having the second support member, and the second support member may be electrically joined by a contact of a contact portion having spring characteristics and provided on the second support member.

It is further conceived that the electrode formed on the surface of the spacer and the electrode formed on either one of the first substrate and the second substrate, having the second support member, are electrically joined through the first support member and the second support member.

It is further conceived that the electron emitting elements are arranged in a matrix and are connected with a matrix wiring constituted of plural row wirings and plural column wirings. In such case, the electron emitting elements may be cold cathode elements, and such cold cathode element may include a conductive thin film, including an electron emission portion, between electrodes. Also the cold cathode element may be a surface conduction electron emitting element.

It is further conceived that the spacer is positioned on a wiring for driving the electron emitting element.

It is further conceived that the second substrate is provided with an image display member for displaying an image upon being irradiated with electrons emitted from the electron emitting element. In such case, the image display member may be a fluorescent film containing a phosphor which emits light by a collision of electrons emitted from the electron emitting element.

In the image display apparatus described above, in positioning the plural spacers on the first substrate or the second substrate on which the spacers are to be installed, the joining of the spacer is executed with welding, soldering or with a low-melting metal material etc. thereby reducing a time or a number of steps required for the spacer assembling. In this manner it is made possible to reduce the manufacturing cost of the image display apparatus.

Also in case of spacer joining with soldering or low-melting metal, it is easily possible to execute repairing assembly of the spacer thereby achieving an improvement in the yield of the spacer assembling step and enabling to provide an image display apparatus of a high reliability.

Also since the joining of the spacer can be achieved by welding, soldering or with a low-melting metal, it is rendered possible to significantly reduce an amount of heat applied at the joining of the spacer, thereby eliminating a strain in a spacer assembling apparatus and improving a positional precision of the spacer. It is thus possible to provide an image display apparatus of a high quality.

Also because of a configuration that a gap is formed, in a direction perpendicular to a surface on which the spacer is provided of a substrate having the spacer, between a spacer joining portion of the first support member and the second support member, and that an external end of the first support member in the longitudinal direction of the spacer impinges on the second support member, the first support member functions in such a direction as to press the spacer to the substrate on which the spacer is provided thereby avoiding a gap between the spacer and the substrate on which the spacer is provided. It is thus rendered possible to prevent a destruction of the spacer or to improve the positional precision of the spacer, thereby providing an image display apparatus of a high quality.

Also because of a configuration that only the external end of the first support member in the longitudinal direction of the spacer is joined to the second support member, it is rendered possible to relax a dimensional difference between the spacer and the rear plate by a thermal expansion at the panel sealing, thus preventing a destruction of the spacer or improving the positional precision of the spacer, thereby enabling to provide an image display apparatus of a high quality.

The present invention is also capable, by the weld joining, of providing an image display apparatus having a spacer, which is strong and has a sufficient supporting function.

The present invention is also capable, by the weld joining, of providing an image display apparatus which is excellent in a precision of fixing position and in which the effect of the spacer on the displayed image is made extremely low.

The present invention is also capable, by the weld joining, of providing an image display apparatus having a spacer with a securely defined potential.

The present invention is also capable of providing an image display apparatus with an extremely little danger of a toppling or a destruction of the spacer by heat at the manufacture or in the drive, since the spacer is fixed by a metal member.

In the present specification, an image area or an image display area means a space sandwiched between a display area of an image displaying substrate in which an image is displayed and an area, corresponding to such display area, of a substrate opposed to the image displaying substrate, and, for example in an electron beam display apparatus, it means a space sandwiched between an electron emitting area and an area irradiated with the emitted electrons.

In the following, embodiments of the present invention will be explained with reference to the accompanying drawings.

FIG. 1 is a perspective view showing an example of a display panel employed in an embodiment of the image display apparatus of the present invention, in which a part of the panel is cut off in order to show the internal structure.

A rear plate 1015 serving as a first substrate, a lateral wall 1016 serving as a frame and a face plate 1017 serving as a second substrate constitute an air-tight container (an outer envelope) for maintaining the interior of the display panel in a vacuum state.

The interior of the air-tight container is maintained at a vacuum of $1.33\times10^{-4}$ Pa or less, so that a spacer 1020 is provided as a structural member for withstanding the atmospheric pressure, in order to prevent the destruction of the air-tight container by the atmospheric pressure or by a sudden impact.

On the rear plate 1015, there is fixed a substrate 1011, on which N×M electron emitting elements 1012 of cold cathode type are formed (N, M being integers equal to or larger than 2 and suitably selected according to a desired number of display pixels). For the electron emitting element of cold cathode type, there can be advantageously employed a surface induction emitting element or an element of FE type or MIM type. On a lower surface of the face plate 1017, there is formed a phosphor film 1018.

Figure 18A:
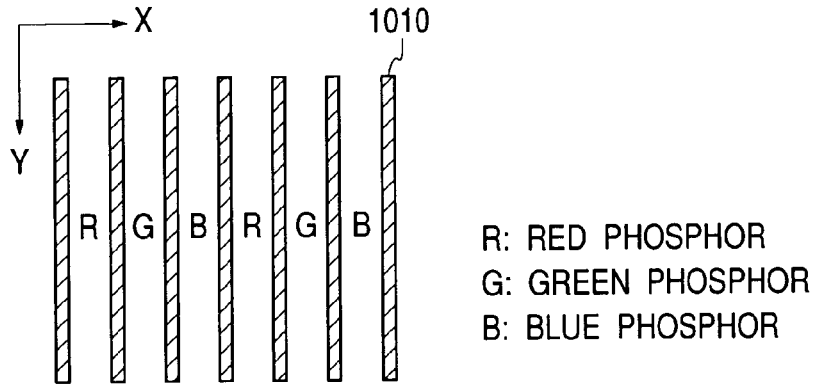
FIGS. 18A, 18B and 18C are plan views showing examples of a phosphor arrangement on a face plate of the display panel shown in FIG. 1.
Figure 18B:
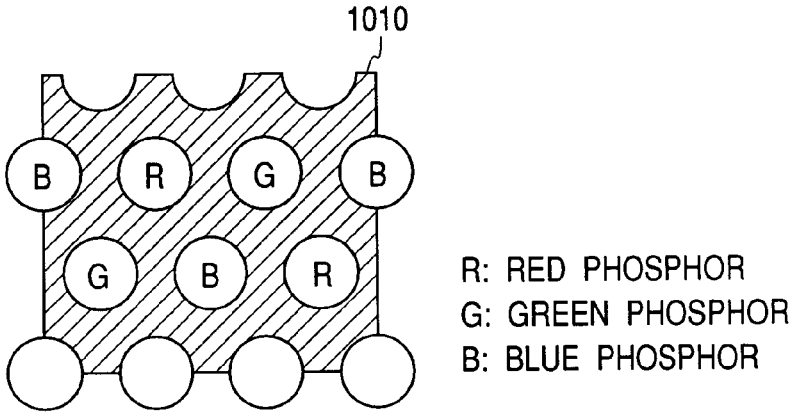
Figure 18C:
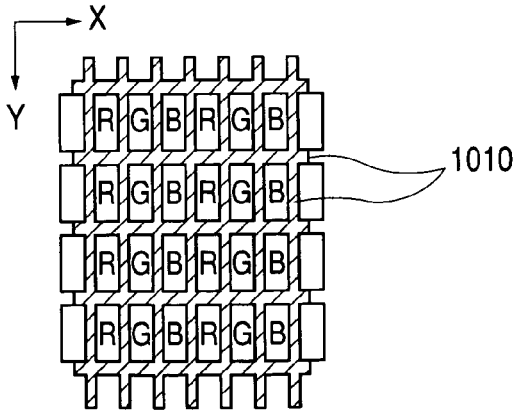

Phosphors of respective colors are provided for example in stripes, and a black conductive material 1010 is provided between striped phosphors (cf. FIG. 18A). However, such striped arrangement is not restrictive, and there may also be employed a delta-shaped arrangement as shown in FIG. 18B or another arrangement (for example as shown in FIG. 18C).

On a surface of the phosphor film 1018 at the side of the rear plate 1015, there is provided a metal back 1019 which is already known in the field of CRT.

Figure 19:
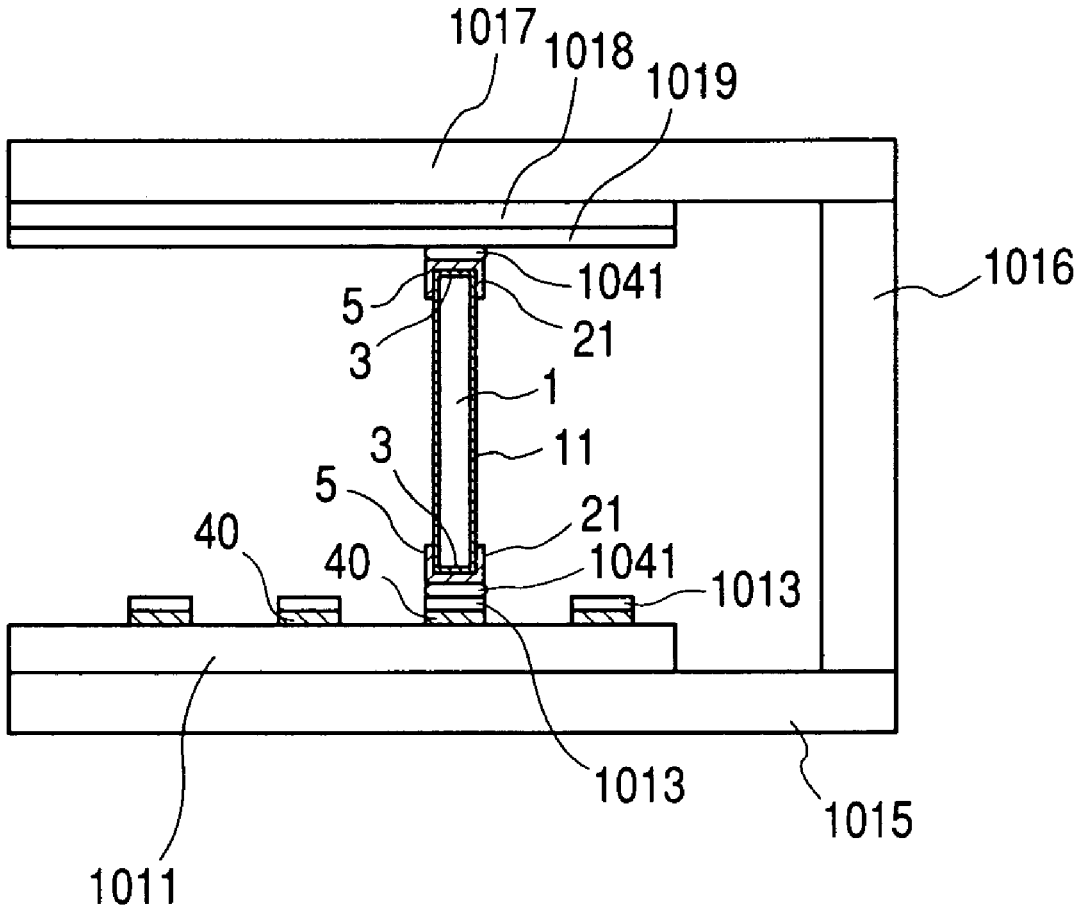
FIG. 19 is a schematic cross-sectional view along a line A—A in FIG. 1.
Figure 20:
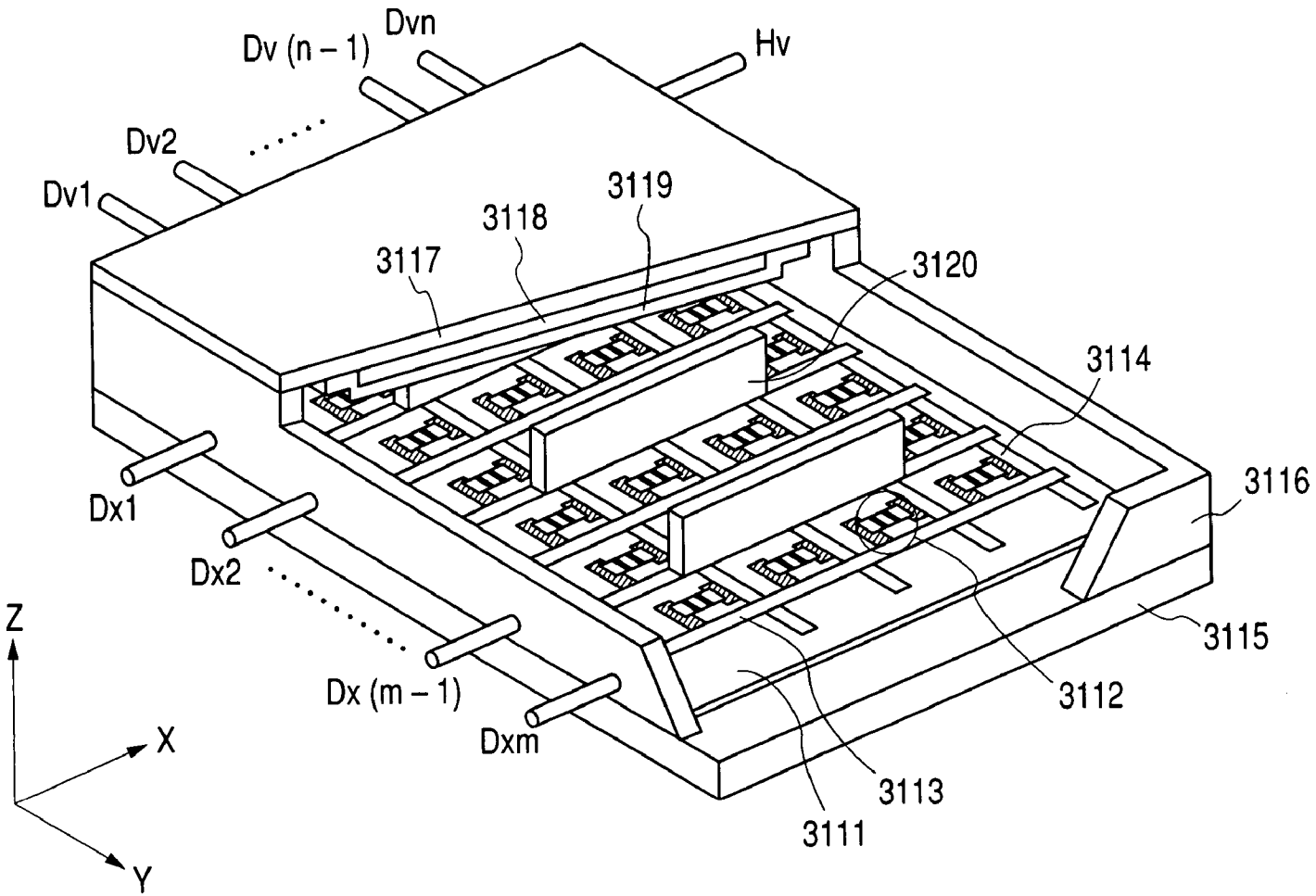
FIG. 20 is a partially cut-off perspective view of a display panel of a prior image display apparatus.

FIG. 19 is a schematic cross-sectional view along a line A—A in FIG. 1, and numbers of components correspond to those in FIG. 1. The spacer 1020 in a preferred embodiment is prepared by forming a high resistance film 11 for charge prevention on an insulating member 1, and also has a low resistance film 21 on an impinging face 3 and an impinging lateral portion 5 of the spacer 1020 opposed to an internal side (metal back 1019 etc.) of the face plate 1017 and a surface (a row wiring 1013 or a column wiring 1014) of the substrate 1011.

The spacer 1020 of a thin plate shape is positioned along a row direction (X-direction), and extends from a range sandwiched between the cold cathode elements 1012 and the phosphor film 1018, to the exterior thereof. On both ends of the spacer 1020, first support members 1030 are fixed in advance. Also the first support member 1030 is joined to a second support member 1033 provided in advance on the rear plate 1015.

Each of the first support member 1030 and the second support member 1033 is preferably formed by a conductive member, a metal or an alloy, for example a stainless steel member, or an alloy principally composed of Ni and Fe. A property required for the first support member 1030 is a thermal expansion coefficient close to that of the spacer 1020 or the substrates.

At first there will be explained an example of the configuration of the first support member 1030, the rear plate 1015 and the second support member 1033, with reference to FIGS. 2A, 2B, 3A, 3B, 4, 5A, 5B and 6.

Figure 2A:
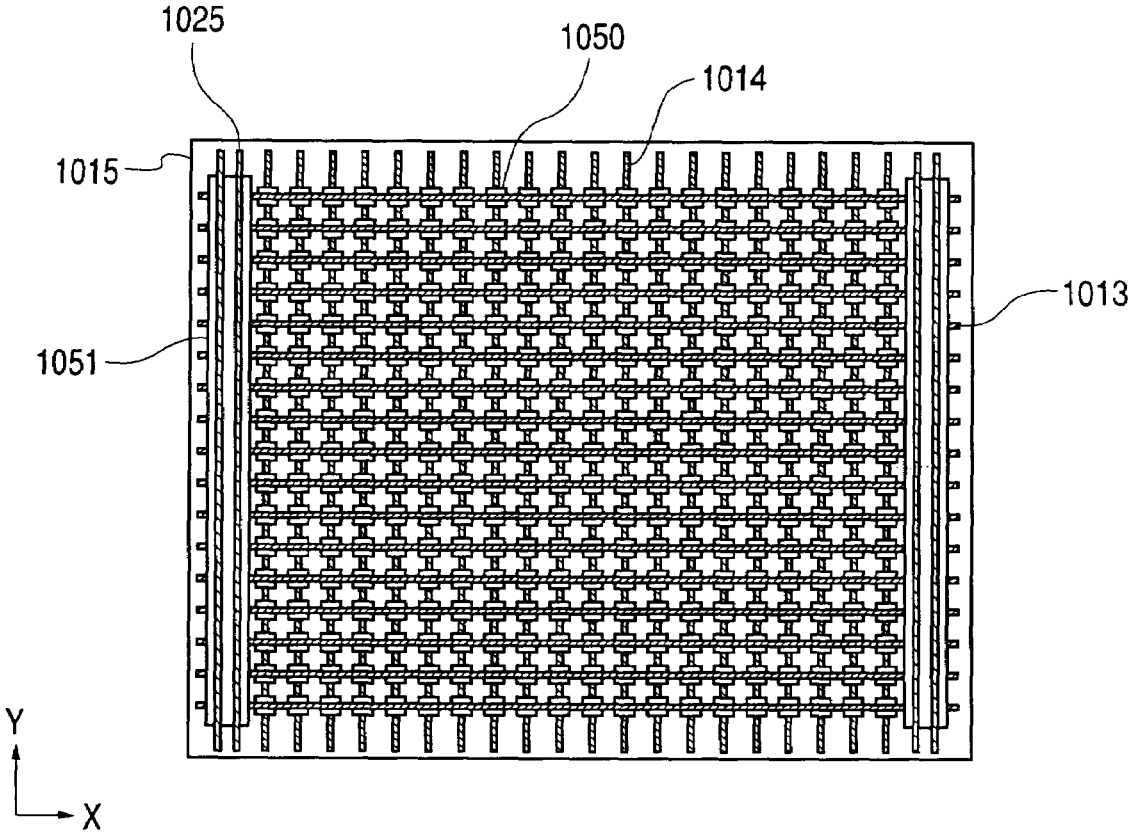
FIGS. 2A and 2B are respectively a plan view and a cross-sectional view, showing a rear plate in FIG. 1.
Figure 2B:
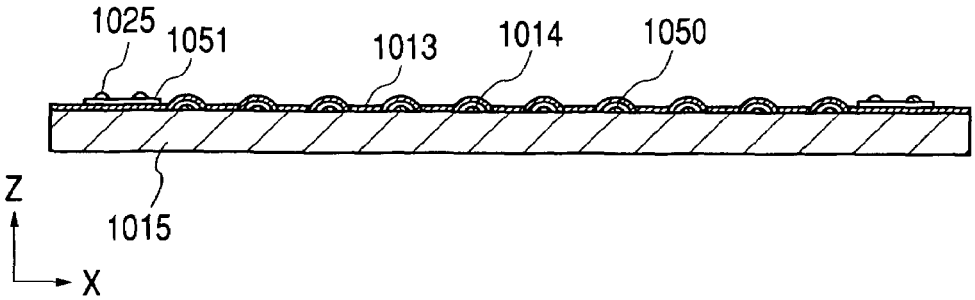
Figure 3A:
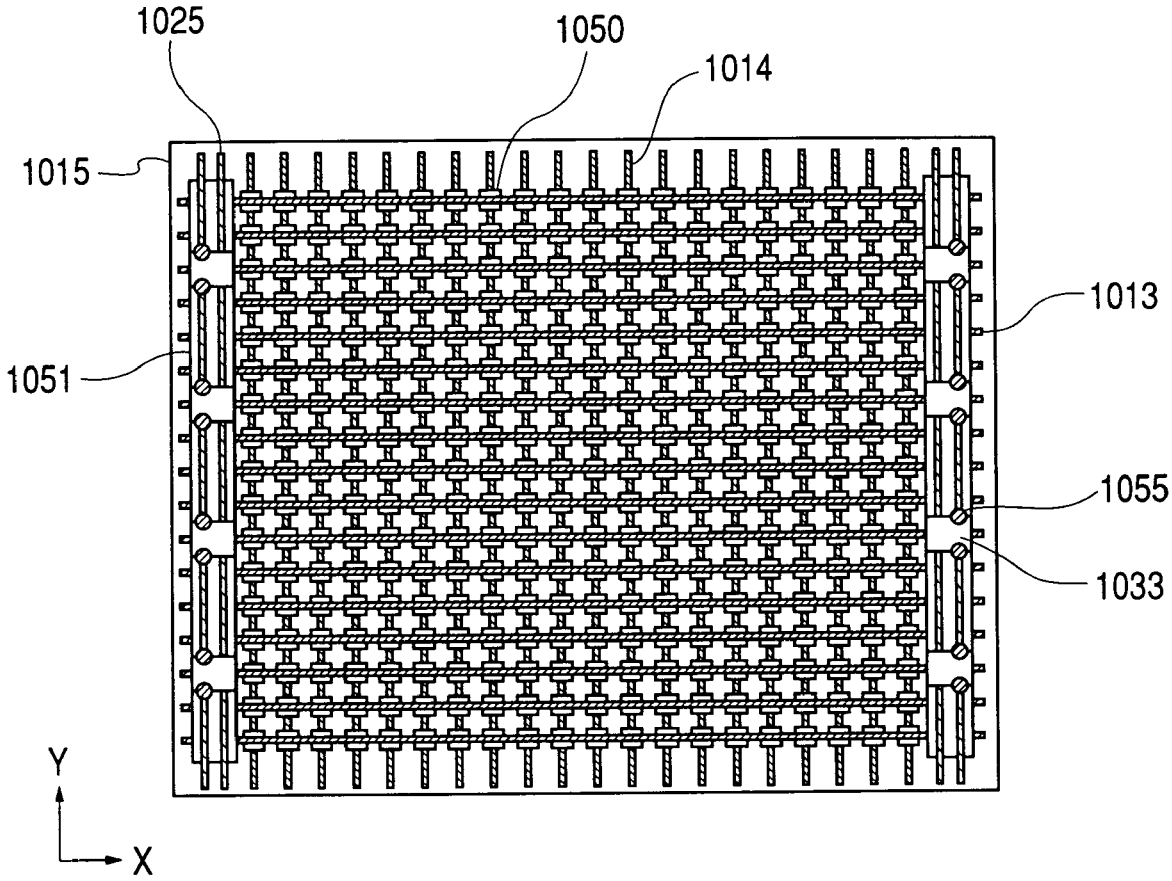
FIGS. 3A and 3B are respectively a plan view and a cross-sectional view, showing a rear plate and a second support member in FIG. 1.
Figure 3B:
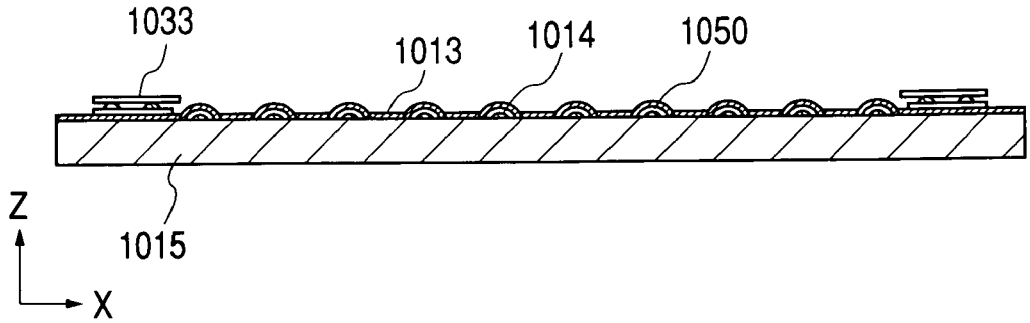

FIGS. 2A and 2B are respectively a plan view and a lateral cross-sectional view of the rear plate, and FIGS. 3A and 3B are respectively a plan view and a cross-sectional view of the rear plate on which the second support member is mounted. In an image display area of the rear plate 1015, there are formed row wirings 1013 and column wirings 1014 for driving electron sources for emitting electrons, and an insulation layer 1050 for electrically insulating the row wirings 1013 and the column wirings 1014. Also outside the image display area of the rear plate 1015 in the longitudinal direction (X-direction) of the row wirings 1013, there are formed row wirings 1013, insulation layer 1041 and a potential defining electrode 1025 having a defined potential. The potential defining electrode 1025 is preferably a ground (GND) electrode. On the GND electrode 1025, a second support member 1033 is fixed by a third joining member 1055. By constituting the third joining member 1055 by a conductive joining member and constituting the second support member 1033 by a conductive member, a metal or an alloy as explained above, the GND electrode 1025 is electrically connected with the second support member 1033. As described in the foregoing, the electrical connection may be achieved by giving electroconductivity to the third joining member 1055 utilized for fixing the second support member 1033 to the rear plate 1015, or by forming a part of the second support member 1033 as a plate spring 1034 (cf. FIG. 13) contacting directly with the GND electrode 1025 of the rear plate 1015.

Figure 4:
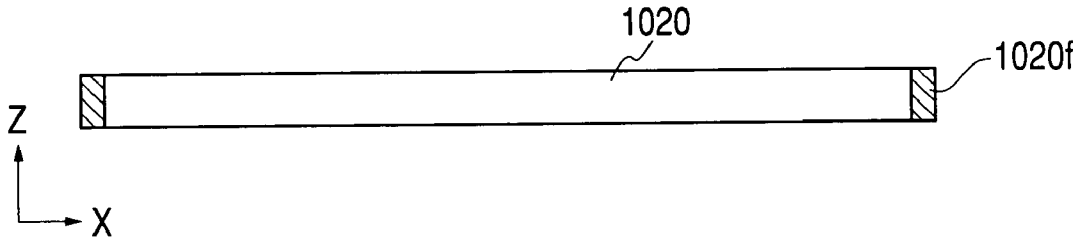
FIG. 4 is a lateral view, along an X-direction, showing a spacer in FIG. 1.
Figure 5A:
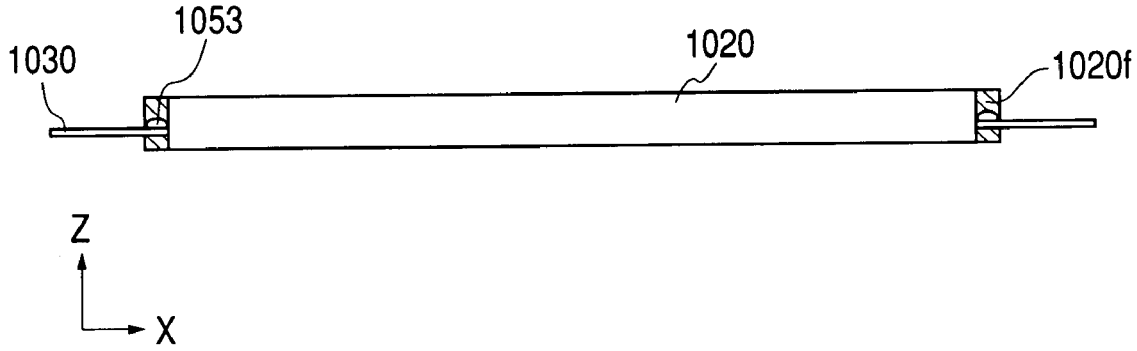
FIGS. 5A and 5B are respectively a lateral view along a Y-direction and a lateral view along an X-direction in FIG. 4, showing a spacer and a first support member in FIG. 1.
Figure 5B:
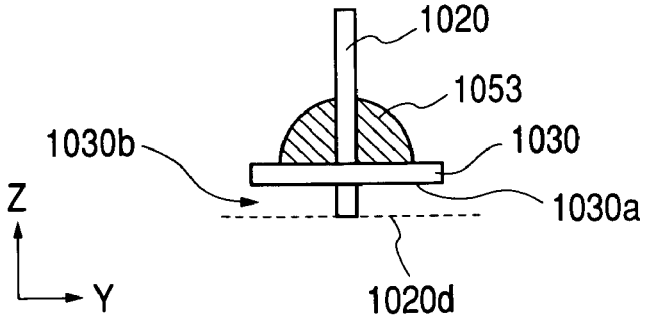

In the following there will be given an explanation of the first support member 1030 with reference to FIGS. 4, 5A and 5B. FIGS. 4 and 5*a* are lateral views of the spacer 1020 and the first support member 1030 seen from a Y-direction, while FIG. 5B is a lateral view seen from an X-direction. It is preferred that a potential defining electrode 1020*f* having a defined potential is formed on both ends of the spacer 1020 to stabilize an isopotential plane within the image display area, and such potential defining electrode is preferably a GND electrode 1020*f* defined at the ground potential. Also the spacer 1020 and the first support member 1030 are fixed with a second joining member 1053. By constituting the first support member 1030 by the conductive member, metal or alloy mentioned in the foregoing and by constituting the second joining member 1053 by a conductive joining member, it is possible to define the potential of the GND electrode 1020*f* through the first support member 1030, and, by rendering the second support member 1033 and the third joining member 1055 also conductive as explained in the foregoing, it is possible to define the potential of the GND electrode 1020*f* by the potential defining electrode 1025. Also, the GND electrode 1020*f* of the spacer 1020 and the first support member 1030 may be in direct contact. Also a predetermined space 1030*b* is formed between a plane 1020*d* of the spacer 1020 including a plane opposed to a spacer bearing plane of the rear plate 1015, and a plane 1030*a* of the first support member 1030 opposed to a spacer bearing plane of the rear plate 1015. The first support member 1030, like the second support member 1033, is formed by an alloy having a thermal expansion coefficient extremely close to that of the rear plate, for example principally composed of Ni and Fe.

In the following there will be explained an joining of the rear plate 1015 and the spacer 1020 with reference to FIGS. 6 and 7.

Figure 6:
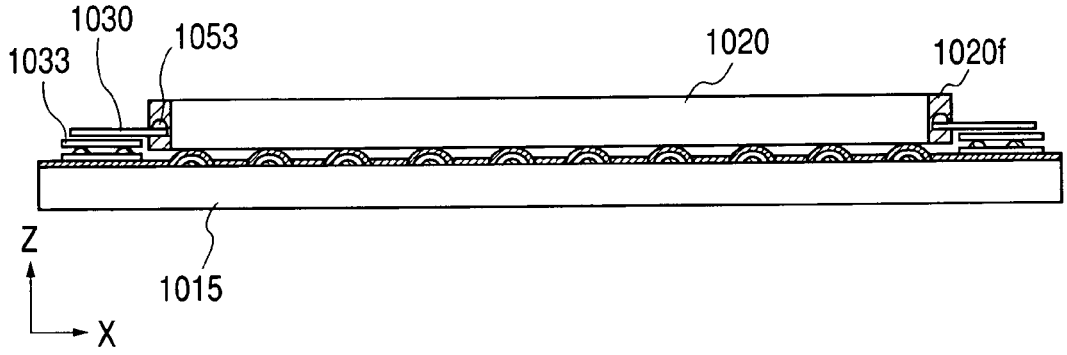
FIG. 6 is a cross-sectional view showing a positional relationship of a rear plate, a spacer, a first support member and a second support member in FIG. 1.

As shown in FIG. 6, the spacer 1020 is aligned, by a spacer assembling apparatus (not shown), at the center of a row wiring 1013 in the image display area of the rear plate 1015, so as to be perpendicular to the plane thereof. In this state, the first support members 1030 joined in advance to both ends of the spacer 1020 by the second joining members 1053 are positioned, across a predetermined space, on the second support members 1033 provided on the rear plate 1015.

Figure 7:
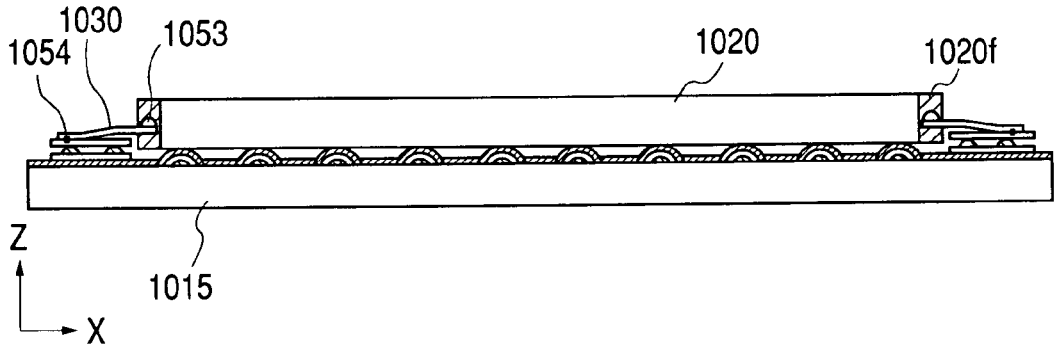
FIG. 7 is a cross-sectional view showing a positional relationship of a rear plate, a spacer, a first support member and a second support member in FIG. 1.

Then, as shown in FIG. 7, a side of the first support member 1030, opposite to a side joined to the spacer, is pressed in a −Z direction to form a curvature in the first support member 1030 thereby causing an external end only of the first support member in the longitudinal direction of the spacer 1020 to impinge on the second support member 1033. In this state, the first support member 1030 and the second support member 1033 are joined by welding in a weld joining portion 1054. In this manner it is possible to securely provide the spacer 1020 in a predetermined position on the rear plate 1015 within a short time and without forming a gap between the rear plate 1015 and the spacer 1020.

Figure 8:
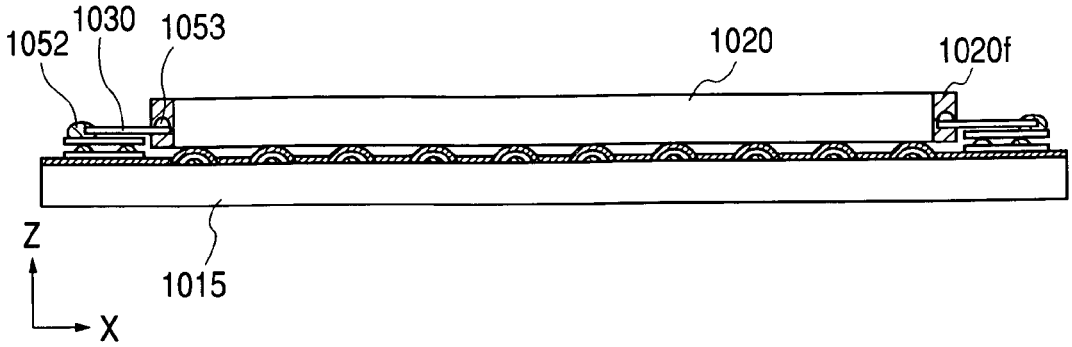
FIG. 8 is a cross-sectional view showing another positional relationship of a rear plate, a spacer, a first support member and a second support member in FIG. 1.

It is also possible, as shown in FIG. 8, to join the first support member 1030 and the second support member 1033 by the first joining member 1052.

The first joining member 1052 can be, for example, a low-melting metal such as solder or indium, a vacuum precious metal solder defined in Japanese Industrial Standard (JIS), or an inorganic adhesive having conductivity. A property required for the first joining member 1052 is little generation of unnecessary gas in vacuum.

In the following there will be explained a procedure for preparing an image display apparatus, with reference to FIGS. 9A, 9B, 9C, 9D and 9E.

Figure 9A:
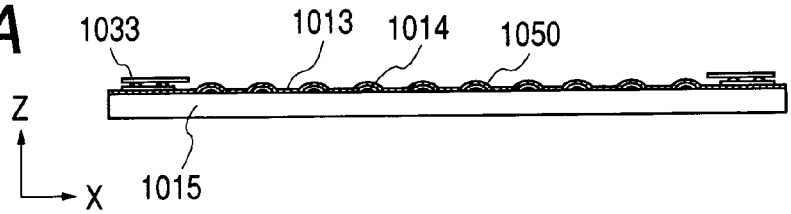
FIGS. 9A, 9B, 9C, 9D and 9E are views showing assembling steps for the panel shown in FIG. 1.

(1) At first, as shown in FIG. 9A, outside the image display area in the longitudinal direction (X-direction) of the row wiring 1013 on the rear plate 1015, there are formed the row wiring 1013, the insulating layer 1051 and the GND electrode 1025, and the second support member 1033 is fixed on the GND electrode 1025 by the third joining member 1055. In this state, the GND electrode 1025 and the second support member 1033 are electrically connected. The electrical connection may be achieved by giving conductivity to the third joining member 1055 utilized for fixing the second support member 1033 to the rear plate 1015, or by forming a part of the second support member 1033 as a plate spring shape 1034 directly impinging on the GND electrode 1025 of the rear plate 1015.

Figure 9B:
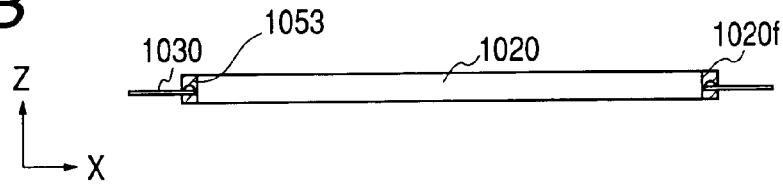

(2) Then, as shown in FIG. 9B, support members 1030 are fixed by the second joining member 1053 on both ends of the spacer 1020. A space is provided between a plate 1020*d* of the spacer 1020 including a plane opposed to the spacer bearing surface of the rear plate 1015, and a place 1030*d* of the support member 1030 opposed to the spacer bearing surface of the rear plate 1015. Such space is preferably somewhat larger than a thickness of the second support member 1033 provided on the rear plate 1015. Also on both ends of the spacer 1020, there are formed GND electrodes 1020*f*, and such GND electrode 1020*f* is electrically joined with the first support member 1030 either by direct contact or through the second joining member 1053.

Figure 9C:
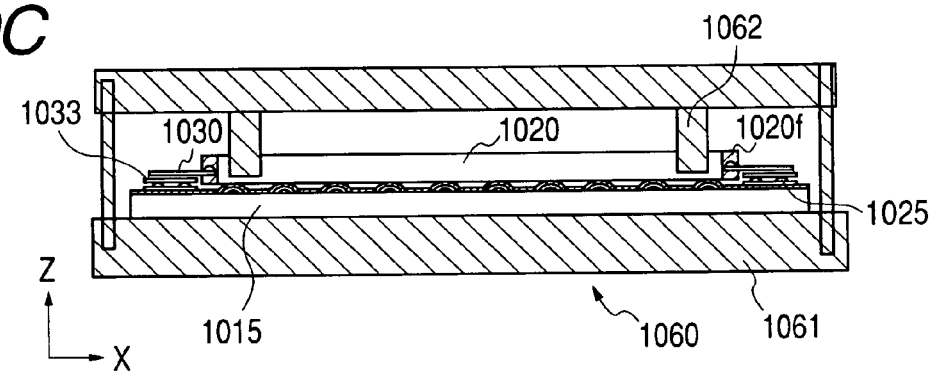

(3) Then, there will be explained a step of aligning the spacer 1020 and the support member 1030 in a predetermined position of the rear plate 1015 utilizing a spacer assembling apparatus 1060 as shown in FIG. 9C. The spacer assembling apparatus 1060 includes a substrate table 1061 for supporting the rear plate 1015 and a spacer clamp unit 1062 for clamping the spacer 1020, and the plane of the substrate table 1061 and a spacer clamping face of the spacer clamp unit 1062 are adjusted to a rectangularity within 90±0.1° C. The spacer clamp unit 1062 is made to clamp a vicinity of the portion fixing the support member 1030 of the spacer 1020 and the spacer 1020 is aligned with a predetermined position of the rear plate 1015 supported on the substrate table 1061.

Figure 9D:
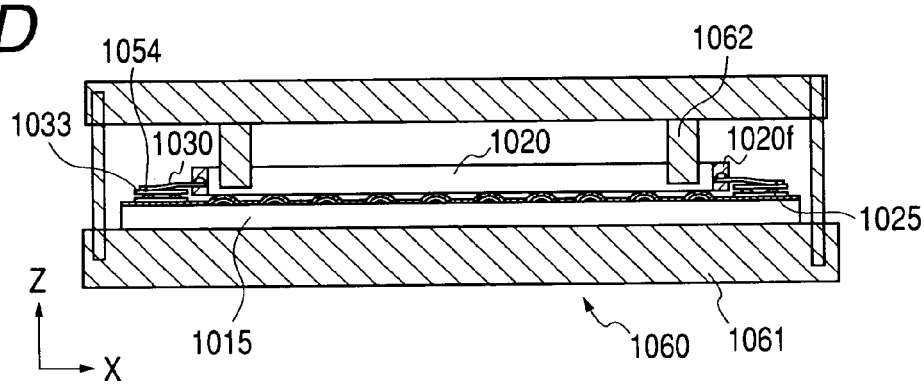

(4) Then, as shown in FIG. 9D, a side of the first support member 1030, opposite to a side joined to the spacer, is pressed in a −Z direction to form a curvature in the first support member 1030 thereby causing an external end only of the first support member in the longitudinal direction of the spacer 1020 to impinge on the second support member 1033. In this state, the first support member 1030 and the second support member 1033 are joined by welding in a weld joining portion 1054. In this manner the spacer 1020 is joined and fixed in a predetermined position on the rear plate 1015. After the joining of the first support member 1030 and the second support member 1033 is completed, the spacer clamp unit 1062 of the spacer assembling apparatus 1060 releases the clamping of both ends of the spacer 1020.

Figure 9E:
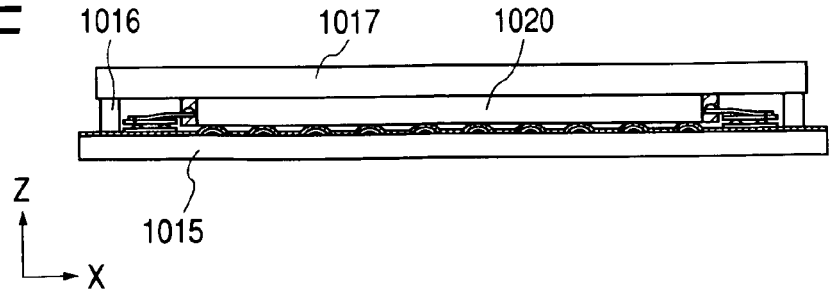

(5) Then the panel sealing of the face plate 1017 and the rear plate 1015 will be explained with reference to FIG. 9E. Such panel sealing is executed by positioning a spacer 1020 and a lateral wall 1016 between the plate place 1017 and the rear plate 1015 as shown in FIG. 1. The lateral wall 1016 is made with a height equal to or slightly lower than the spacer 1020. Therefore, a gap between the face plate 1017 and the rear plate 1015 is defined by the height of the spacer 1020. The sealing of the lateral wall 1016 with the face plate 1017 and the rear plate 1015 is principally made with frit glass. The frit glass is positioned between the rear plate 1015 and the lateral wall 1016 and between the lateral wall 1016 and the face plate 1017. The sealing is executed by coating the frit glass on a position of the rear plate 1015 and the face plate 1017 coming into contact with the lateral wall 1016 and heating the face plate 1017 and the rear plate 1015 externally until the surfaces of the rear plate 1015 and the face plate 1017 contacting the lateral wall 1016 reach about 400° C. Then the face plate 1017 is brought closer to the rear plate 1015 so as to be parallel thereto and both members are cooled after pressurizing. Thereafter a closed space surrounded by the face plate 1017, the rear plate 1015 and the lateral wall 1016 is brought to a vacuum state.

As explained in the foregoing, the metal first support members 1030 are fixed on both ends of the spacer 1020 longer than the image area, while the metal second support members 1033 are provided on predetermined positions on the rear plate 1015, and the first support member 1030 and the second support member 1033 are fixed by a weld joining or by the first joining member 1052 having conductivity such as a solder.

It is thus possible to position the spacer 1020 on the rear plate 1015 within a short time, by joining the first support members 1030 joined to the both ends of the spacer 1020 and the second support members 1033 provided in the predetermined positions on the rear plate 1015 by weld joining or by the first joining member 1052 such as solder. It is thus possible to reduce the production cost of the image display apparatus.

Also in case of joining the first support member 1030 and the second support member 1033 with a solder, there can be easily achieved a repair assembling of the spacer 1020, whereby it is possible to achieve an improvement in the manufacturing yield of the assembling step for the spacer 1020 and a reduction of the manufacturing cost.

Also, since the joining of the spacer 1020 can be achieved by welding, soldering or with a low-melting metal, it is possible to significantly reduce the amount of heat applied at the joining of the spacer 1020, thereby eliminating a strain in the spacer assembling apparatus and improving the positional precision of the spacer 1020. In this manner it is rendered possible to provide an image display apparatus of a high quality.

Also, since the first support member 1030 used for joining the spacer 1020 and the second support member 1033 joined to the GND electrode 1025 of the rear plate 1015 are formed by conductive metal plates, and also since the first support member 1030 and the second support member 1033 are joined either by a welding 1054 or by a conductive first joining member 1052, it is possible to execute the electrical joining of the spacer 1020 and the electrical joining of the GND electrode 1020*f* of the spacer 1020 and the GND electrode 1025 of the rear plate 1015 at the same time. In this manner there can be achieved a simplification of the assembling process of the spacer 1020, and a reduction in the manufacturing cost.

Also because of a configuration that a gap is formed, in a direction perpendicular to the spacer bearing surface the rear plate 1015, between a spacer joining portion of the first support member 1030 and the second support member 1033, and that the external end of the first support member in the longitudinal direction of the spacer 1020 impinges on the second support member 1033, the first support member 1030 functions in such a direction as to press the spacer 1020 to the rear plate 1015 thereby avoiding a gap between the spacer 1020 and the rear plate 1015. It is thus rendered possible to prevent a destruction of the spacer or to improve the positional precision of the spacer 1020, thereby enabling to provide an image display apparatus of a high quality.

Also since a heating for the panel sealing has been executed with a planar heater or a heating lamp from a surface, opposite to the surface of the rear plate 1015 or the face plate 1017, facing the closed space therein, the rear plate 1015 reaches a temperature higher than in the spacer 1020 at the heating to generate a dimensional difference by thermal expansion between the spacer 1020 and the rear plate 1015, whereby the spacer 1020 is extended longitudinally and destructed. Against such problem, the first support member 1030 joined to the spacer 1020 is formed by a metal material of a high thermal conductivity to facilitate transmission of heat from the rear plate 1015, and the first support member 1030 is joined only at the external end thereof, in the longitudinal direction of the spacer 1020, with the second support member 1033, whereby the first support member 1030 generates a thermal expansion toward the center of the longitudinal direction of the spacer 1020 thereby compensating the dimensional difference by thermal expansion between the spacer 1020 and the rear plate 1015 at heating. Such prevention of the destruction of the spacer 1020 allows to improve the yield of the assembling step of the spacer 1020 and to provide an image display apparatus of a high reliability.

EXAMPLES

The support members for the spacer 1020, the rear plate 1015 and the joining method therefor explained in the foregoing will be further clarified by specific examples of materials and numerical examples, but the present invention is not limited by such examples.

First Example

In this example, there will be explained preparation of a display panel with reference to FIGS. 1, 2A, 2B, 3A, 3B, 4, 5A, 5B, 6, 7, 12, 14A and 14B.

At first, on a substrate 1101 as shown in FIG. 1, there were prepared row wirings 1013, column wirings 1014, an inter-electrode insulation layer (not shown), and element electrodes and conductive thin films of surface conduction electron emitting elements 1012. This display apparatus had an image display area of 280×210 mm.

Then a spacer 1020, constituting a structural member of the display panel for withstanding the atmospheric pressure (cf. FIG. 1), was prepared with an insulating member (300 mm×2 mm×0.2 mm) of soda lime glass. The spacer 1020 was prepared in an elongated form of a cross section of 2 mm×0.2 mm by a heat extending method and was cut into a desired dimension.

A high resistance film to be explained later was formed, among the surfaces of the spacer 1020, on four surfaces positioned in the image display area of the air-tight container (namely two surfaces each of 300×2 mm and 300×0.2 mm), and a conductive film was formed on two surfaces (two surfaces of 280×0.2 mm) coming into contact with the image display area of the face plate 1017 and the rear plate 1015, and, on surfaces of 280×2 mm, in regions of a height of 0.1 mm (280×0.1 mm) from edges coming into contact with the face plate 1017 and the rear plate 1015. Also a conductive film was formed on four surfaces close to the both ends of the spacer 1020, with an insulating gap of 2 mm to the conductive films formed in the image display area.

As the high resistance film, there was employed a Cr—Al alloy nitride film (200 nm thick, about 109 $\Omega/cm^2$) formed by simultaneous sputtering of Cr and Al targets with a high frequency power source. The conductive film provided in the image area serves not only for securing an electrical connection between the high resistance film formed on the spacer 1020 and the face plate 1017 and between the high resistance film and the rear plate 1015, but also for suppressing an electrical field around the spacer 1020 thereby controlling a trajectory of the electron beam from the electron emitting element. Also the conductive film provided outside the image area is electrically connected with a GND electrode 1025, which is provided as a GND electrode 1020*f* outside the image area of the rear plate 1015.

Figure 10:
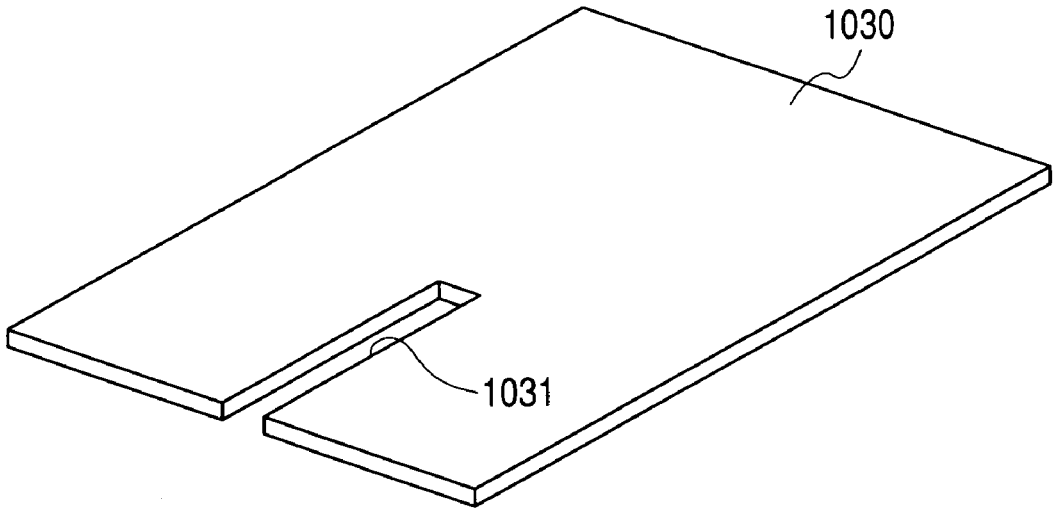
FIG. 10 is a view showing a first support member in FIG. 1.

The first support member 1030 is formed by an alloy having a thermal expansion coefficient extremely close to that of the rear plate 1015, principally composed for example of Ni and Fe. The first support member 1030 has a shape as shown in FIG. 10, of 5×3 mm (length and width) and 0.1 mm (thickness), with a central groove 1031 (0.25 mm) of a length of 1.5 mm for accepting the spacer 1020.

Figure 12:
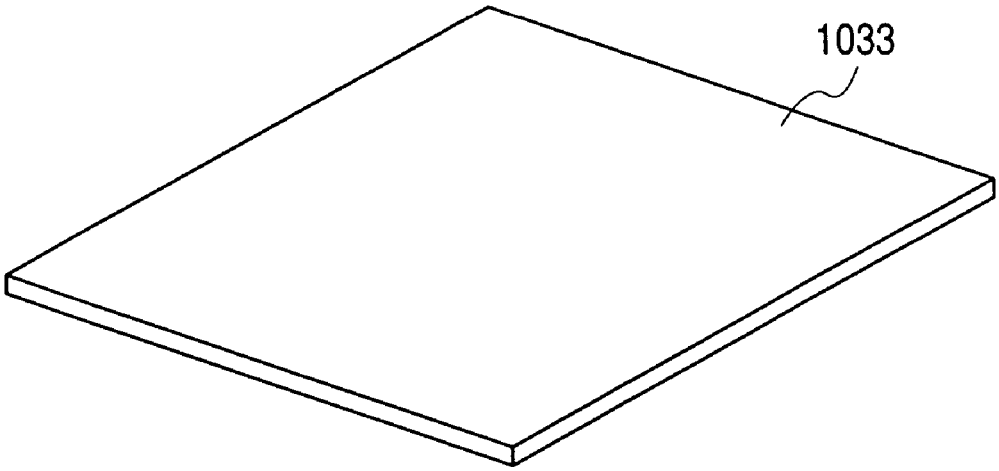
FIG. 12 is a view showing a second support member in FIG. 1.

The second support member 1033 is formed by an alloy having a thermal expansion coefficient extremely close to that of the rear plate 1015, principally composed for example of Ni and Fe. The second support member 1033 has a shape as shown in FIG. 12, of 3×3 mm (length and width) and 0.1 mm (thickness).

As shown in FIGS. 2B and 3B, the rear plate 1015 is so constructed as to have a substantially same thickness, in a direction of thickness of the substrate, on the row wiring 1013 within the image display area of the rear plate 1015 and to be contacted by the spacer 1020, and in a portion outside the image display area of the rear plate 1015 where the second support member 1033 is to be fixed. In the portion where the second support member 1033 is to be fixed, there is formed a GND electrode 1025.

The second joining member 1053 was composed of a conductive inorganic adhesive containing Ni fillers of about 0.02 mmϕ.

The third joining member 1055 was composed of a conductive inorganic adhesive containing Ni fillers of about 0.02 mmϕ.

For welding the first support member 1030 and the second support member 1033, a spot welding was used. Instead, there may also be utilized a laser welding. Such weld joining methods are executed by local heating, thereby not thermally affecting the spacer 1020 or the rear plate 1015.

As shown in FIGS. 4, 5A and 5B, the groove (width 0.25 mm, length 1.5 mm) provided at the center of the first support member 1030 is fitted to both ends of the spacer 1020, and is fixed with the second joining member 1053. In this operation, the GND electrode 1020*f* of the spacer 1020 and the first support member 1030 are electrically connected through the second joining member 1053.

Also between a plane 1020*d* including a plane opposed to the spacer bearing surface of the rear plate 1015 and a plane 1030*a* opposed to the spacer bearing surface of the rear plate 1015, there is formed a space of a dimension approximately equal to the thickness of the second support member 1033.

As shown in FIGS. 2A, 2B, 3A and 3B, on the GND electrode 1025 which was positioned outside the image display area and on the extension of the row wiring which was contacted by the spacer 1020 in the image display area of the rear plate 1015, the second support member 1033 was joined with insulating frit glass. At the joining, a contact spring portion 1034 of the second support member 1033 was so positioned on the GND electrode 1025 of the rear plate 1015, as to form an electrical connection of the two.

Now there will be explained an assembling of the spacer 1020 and the rear plate with reference to FIGS. 6 and 7.

The spacer 1020 was contacted, by the spacer assembling apparatus, substantially vertically on the central part of the row wiring 1013 in the image display area of the rear plate 1015, then a side of the first support member 1030, opposite to a side joined to the spacer, was pressed in a −Z direction to form a curvature in the first support member 1030 thereby causing an external end only of the first support member 1030 in the longitudinal direction of the spacer 1020 to impinge on the second support member 1033. In this state, since the first support member functions in such a direction as to press the spacer 1020 toward the rear plate 1015 thereby avoiding a gap formation between the spacer 1020 and the rear plate 1015. Also in this state, the first support member 1030 and the second support member 1033 are joined by spot welding in the weld joining portion 1054. In this manner the spacer 1020 is fixed in a predetermined position on the rear plate 1015. In this operation, the GND electrode 1020*f* of the spacer 1020 and the GND electrode 1025 of the rear plate 1015 were electrically joined.

Thereafter, as shown in FIG. 1, the lateral wall 1016 was mounted on the rear plate 1015 across frit glass, and frit glass was also coated on a part of the lateral wall 1016 to be contacted with the face plate 1017. On the internal surface of the face plate 1017, there were provided a phosphor film 1018 composed of phosphors of respective colors in stripe shapes extending in the direction of the column wirings (Y-direction), and a metal back 1019.

Then the face plane 1017 and the rear plate 1015 were brought closer with the planes thereof maintained mutually parallel and the wall 1016, the face plate 1017 and the rear plate 1015 were joined and sealed by sintering for 10 minutes or longer at 400 to 500° C.

The interior of thus completed air-tight container was evacuated with a vacuum pump through an exhaust pipe, and after a vacuum of a sufficient level was reached, the elements were powered through the external terminals Dx1–DxM and Dy1–Dyn and the row wirings 1013 and the column wirings 1014 to execute an electroforming process and an electric activation as explained in the foregoing to obtain a multi electron beam source.

Then, at a vacuum of about $1.33\times10^{-4}$ Pa, the unrepresented exhaust pipe was fused off by heating with a burner, thereby sealing the envelope (air-tight container).

Finally, a getter process was executed for maintaining the vacuum level after the sealing.

Thus completed display panel, as shown in FIG. 1, was employed in an image display apparatus, and, scanning signals and modulation signals were applied by unrepresented signal generation means to the cold cathode elements (surface conduction electron emitting elements) 1012 respectively through the external terminals Dx1–DxM and Dy1–DyN to emit electrons, while a high voltage was applied to the metal back 1019 through the high voltage terminal Hv to accelerate the emitted electron beams and to cause the electrons to collide with the phosphor film 1018, thereby exciting the phosphors of the respective colors and causing light emission therein whereby an image was displayed. A voltage Va applied to the high voltage terminal Hv was selected as 3 to 10 kV, while a voltage Vf applied between the wirings 1013, 1014 was selected as 14 V.

In this operation, there were formed light emission spots arranged two dimensionally with a uniform distance, including the light spots formed by the electrons emitted from the cold cathode elements 1012 positioned close to the spacer 1020, whereby a sharp color image could be formed with a satisfactory color reproduction.

Second Example

Another example of assembling of the foregoing example will be explained with reference to FIGS. 11, 15A, 15B, 16, 17, 18A, 18B and 18C.

The first support member 1030 may be formed for example by stainless steel or an alloy principally composed of Ni and Fe. The first support member 1030 is required to have a thermal expansion coefficient close to that of the spacer 1020 or members constituting the substrates.

Figure 11:
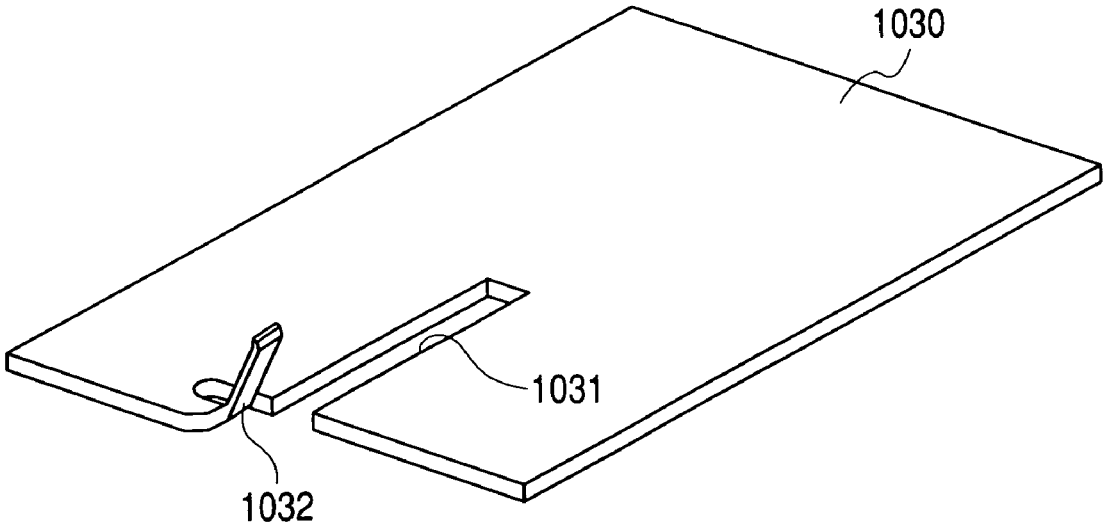
FIG. 11 is a view showing another shape of the first support member in FIG. 1.

It has a shape as shown in FIG. 11, with dimensions of 5×3 mm (length, width) and 0.1 mm (thickness) and with a central groove 1031 (0.25 mm) of a length of 1.5 mm for receiving the spacer 1020, and is also provided with a spring-shaped portion 1032 for electrical contact with the GND electrode 1020*f* of the spacer 1020.

The second support member 1033 was formed by a material similar to that of the first support member 1030.

Figure 13:
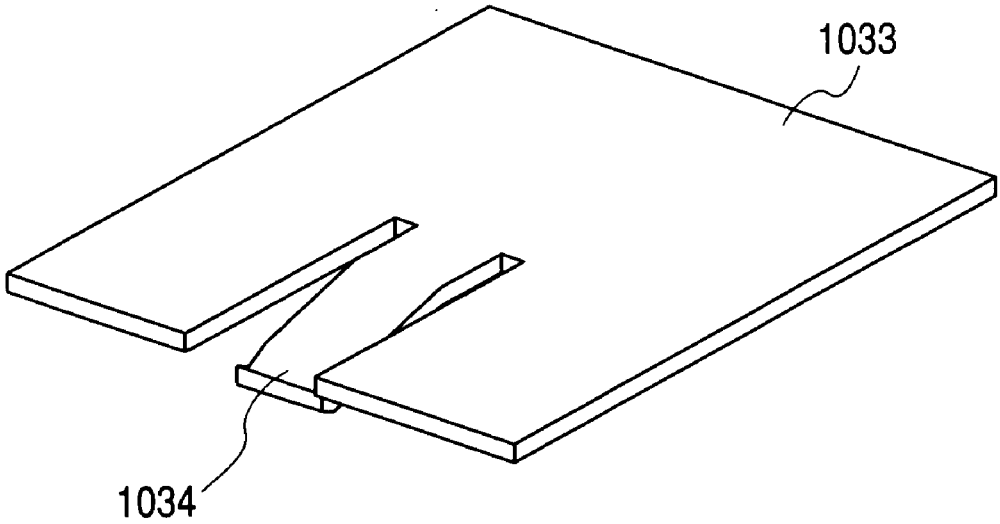
FIG. 13 is a view showing another shape of the second support member in FIG. 1.
Figure 14A:
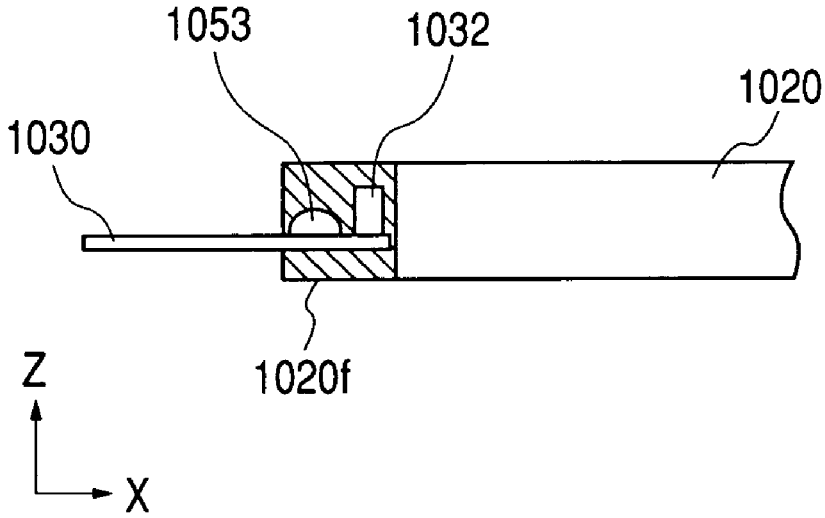
FIGS. 14A and 14B are respectively a lateral cross-sectional view along a Y-direction and a lateral cross-sectional view along an X-direction, showing another form of a spacer and a first support member in FIG. 1.
Figure 14B:
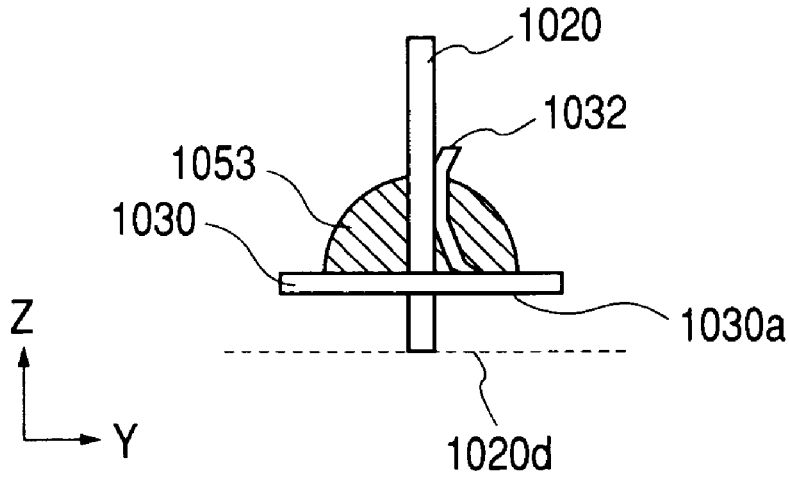

It has a shape as shown in FIG. 13, with dimensions of 3×3 mm (length, width) and is also provided, at the outside, with a spring-shaped portion 1034 for electrical contact with the GND electrode 1025 of the rear plate 1015. It has a thickness of 0.1 mm same as that of the first support member 1030.

As shown in FIGS. 2A, 2B, 3A and 3B, the rear plate 1015 is so constructed as to have a substantially same thickness, in a direction of thickness of the substrate, on the row wiring 1013*a* within the image display area of the rear plate 1015 and to be contacted by the spacer 1020, and in a portion outside the image display area of the rear plate 1015 where the second support member 1033 is to be fixed. In the portion where the second support member 1033 is to be fixed, there is formed a GND electrode 1025.

As the first joining member 1052, there was employed solder or the like. The solder material employed had scarce degassing in vacuum and satisfactorily wets the first support member 1030 and the second support member 1033.

As the second joining member 1053, there was employed an inorganic adhesive utilizing alumina as a principal component. The second joining member 1053 was electrically insulating.

As the third joining member 1055, there was employed an inorganic adhesive utilizing alumina as a principal component. The third joining member 1055 was electrically insulating.

Assembling of Spacer and First Support Member

Now reference is made to FIG. 14 for explaining an assembling of the spacer 1020 and the first support member.

The groove (width 0.25 mm, length 1.5 mm) provided at the center of the first support member 1030 is fitted to both ends of the spacer 1020, and is fixed with the second joining member 1053. In this operation, the GND electrode 1020*f* of the spacer 1020 is directly contacted by the contacting spring portion 1032 of the first support member 1030 to form an electrical joining of the two. Also between a plane 1020*d* including a plane opposed to the spacer bearing surface of the rear plate 1015 and a plane 1030*a* opposed to the spacer bearing surface of the rear plate 1015, there is formed a space of a dimension slightly larger than the thickness of the second support member 1033.

Figure 15A:
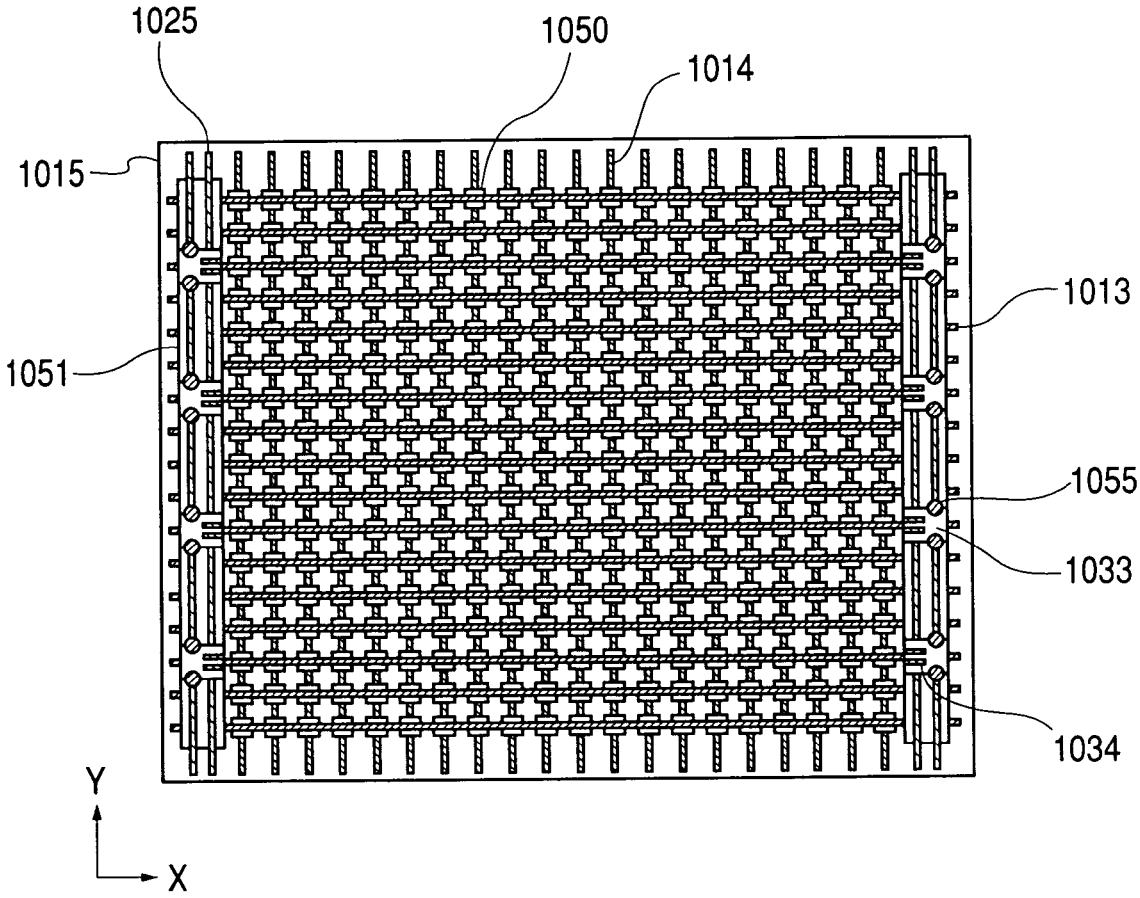
FIGS. 15A and 15B are respectively a plan view and a cross-sectional view showing another positional relationship of a rear plate and a second support member in FIG. 1.
Figure 15B:
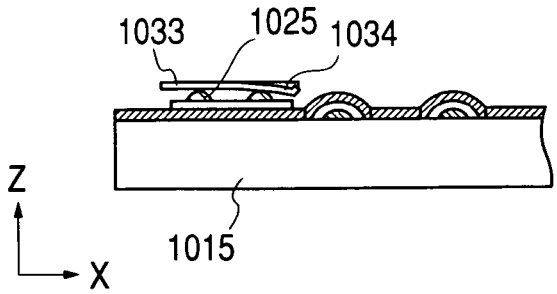

Now reference is made to FIGS. 15A and 15B for explaining an assembling of the spacer 1020 and the second support member.

On the GND electrode 1025 which was positioned outside the image display area and on the extension of the row wiring which was contacted by the spacer 1020 in the image display area of the rear plate 1015, the second support member 1033 was joined with conductive frit glass. In this operation, the GND electrode 1025 of the rear plate 1015 and the second support member 1033 were electrically joined through such conductive frit glass.

Figure 16:
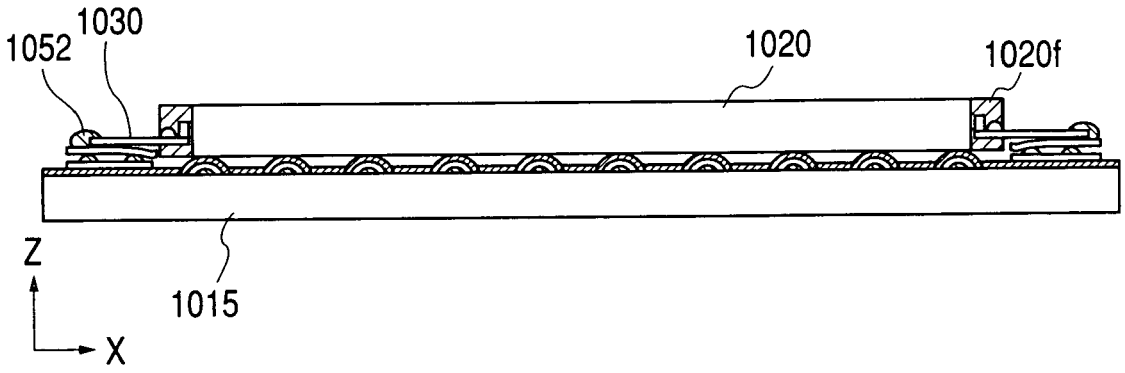
FIG. 16 is a cross-sectional view showing a positional relationship of a rear plate, a spacer, a first support member and a second support member in FIG. 1.

The spacer 1020 is contacted, by the spacer assembling apparatus, substantially vertically on the central part of the row wiring 1013 in the image display area of the rear plate 1015. In this state, as shown in FIG. 16, an external end of the first support member 1030 in the longitudinal direction of the spacer 1020 and the second support member 1033 are joined by the first joining member 1052. In this manner the spacer 1020 is joined and fixed in a predetermined position on the rear plate 1015.

Also by such joining, the GND electrode 1020*f* of the spacer 1020 and the GND electrode 1025 of the rear plate 1015 are electrically joined.

The sealing of the rear plate and the face plate and processing and sealing of the electron source are similar to those in the first example.

Third Example

Another example of assembling of the foregoing examples will be explained with reference to FIG. 17.

Figure 17:
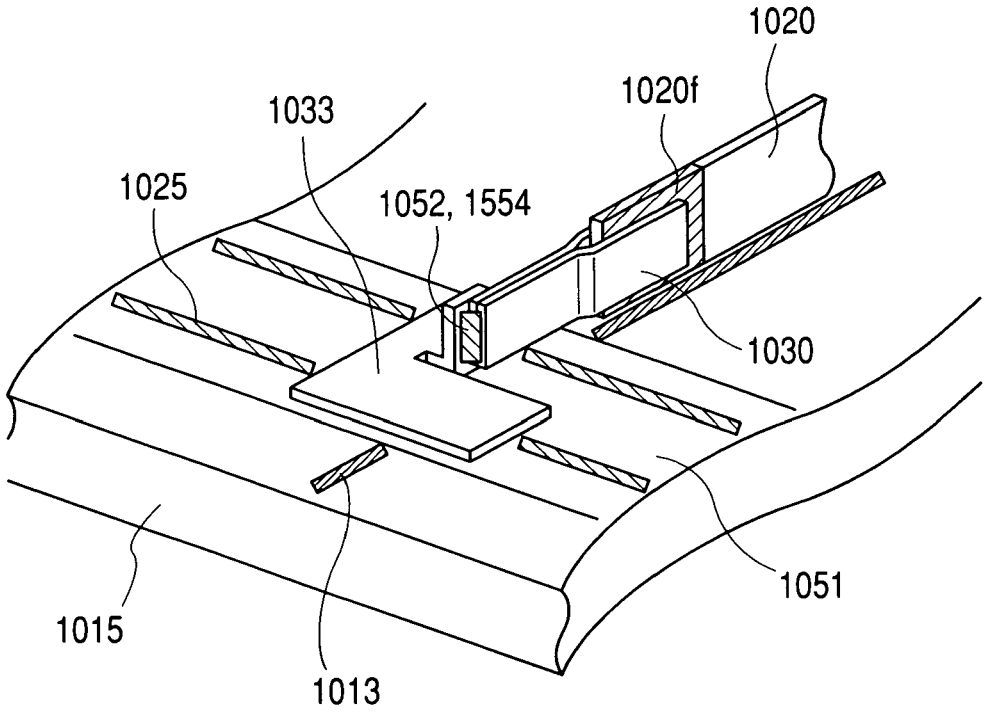
FIG. 17 is a cross-sectional view showing another positional relationship of a rear plate, a spacer, a first support member and a second support member in FIG. 1.

As another shape of the first support member 1030, there may be employed a Y-shape as shown in FIG. 17. In such case, the spacer 1020 is joined by inserting into a groove of such Y-shape. The joining may be executed by the third joining member 1055, or by clamping the spacer 1020 by the Y-shaped first support member 1030.

The second support member 1033 was formed by a material similar to that of the first support member 1030.

As shown in FIG. 17, it has a surface parallel to the image display surface of the rear plate 1015 and a surface perpendicular thereto.

The spacer 1020 was contacted, by the spacer assembling apparatus, substantially vertically on the central part of the row wiring 1013 in the image display area of the rear plate 1015. In this state, as shown in FIG. 17, the external end of the first support member 1030 in the longitudinal direction of the spacer 1020 and the second support member 1033 joined by welding or by the first joining member 1052. In this manner the spacer 1020 is fixed in a predetermined position on the rear plate 1015. Also in this operation, the GND electrode 1020*f* of the spacer 1020 and the GND electrode 1025 of the rear plate 1015 are electrically joined.

Other configurations and steps are similar to those in the first example.

EFFECT OF THE INVENTION

The present invention is capable of providing an image display apparatus having a spacer which is strong and has a sufficient supporting function.

The present invention is also capable of providing an image display apparatus in which a spacer has an excellent precision in the fixing position and has an extremely lowered influence on the displayed image.

The present invention is also capable of providing an image display apparatus equipped with a spacer with a securely defined potential.

The present invention is also capable of providing an image display apparatus with extremely little danger of toppling or destruction of the spacer by heat at the manufacture or during the drive.

What is claimed is:

1. An image display apparatus comprising:

a first substrate provided with a plurality of electron emitting elements in a vacuum container;

a second substrate positioned opposite to said first substrate in said vacuum container, said second substrate being irradiated with electrons emitted from said electron emitting elements;

at least one spacer disposed on either one of said first and second substrates to provide an atmospheric pressure resistant structure of said vacuum container, said spacer being interposed between said first and second substrates and having a longitudinal direction in a direction substantially perpendicular to an opposing direction of said first and second substrates; and a lateral wall positioned inside an external periphery of at least either one of said first and second substrates to provide a sealed structure of said vacuum container, wherein a first support member for supporting said spacer is provided outside an image display area which is formed between an area of said electron emitting elements of said first substrate and an electron-irradiated area of said second substrate, while a second support member is provided outside said image display area of either one of said first and second substrates, and wherein said first support member and said second support member are joined together, wherein said first and second support members consist of members having conductivity, and wherein an electrode formed on either one of said first and second substrates, bearing said second support member, is electrically joined to said second support member by contact of a contact portion having spring characteristics, provided on said second support member.

* * * * *